US008056448B2

(12) United States Patent
Chen

(10) Patent No.: US 8,056,448 B2
(45) Date of Patent: Nov. 15, 2011

(54) MULTI-SIZE WRENCH

(75) Inventor: Tai-Hung Chen, Fusing Township, Changhua County (TW)

(73) Assignee: Infar Industrial Co., Ltd., Changhua County (TW)

( * ) Notice: Subject to any disclaimer, the term of this patent is extended or adjusted under 35 U.S.C. 154(b) by 199 days.

(21) Appl. No.: 12/501,080

(22) Filed: Jul. 10, 2009

(65) Prior Publication Data

US 2011/0005357 A1 Jan. 13, 2011

(51) Int. Cl.
*B25B 13/02* (2006.01)
*B25B 13/50* (2006.01)

(52) U.S. Cl. ..... 81/121.1; 81/186; 81/125.1; 81/124.3

(58) Field of Classification Search ..... 081/121.1, 081/119, 124.4, 124.7, 125.1, 186, 124.3
See application file for complete search history.

(56) References Cited

U.S. PATENT DOCUMENTS

| | | | | |
|---|---|---|---|---|
| 5,012,706 | A * | 5/1991 | Wright et al. | 81/121.1 |
| 5,388,486 | A * | 2/1995 | Ruzicka et al. | 81/121.1 |
| 7,270,032 | B1 * | 9/2007 | Hsieh | 81/121.1 |
| 2008/0105093 | A1 * | 5/2008 | Hart | 81/125.1 |

* cited by examiner

*Primary Examiner* — Hadi Shakeri

(57) ABSTRACT

A multi-size wrench is defined with an engaging hole in a head thereof, and an inner surface of the engaging hole of the head is formed by six arc-shaped engaging concaves and six arc-shaped connecting convexes which are alternatively connected to each other in such a manner that between each two neighboring engaging concaves is connected a connecting convexes. An angle between the connecting lines from two ends of the respective arc-shaped engaging concaves to the center of the engaging hole is 50 degrees, and an angle between the connecting lines from the center of the engaging hole to a middle connecting point of each arc-shaped connecting convexes and to a connecting end of the connecting convex is 5 degrees. By such arrangements, the multi-size wrench is applicable to a Metric hexagonal fastener, an English hexagonal fastener and a torx fastener which are correspondingly sized.

6 Claims, 9 Drawing Sheets

MULTI-SIZE WRENCH

BACKGROUND OF THE INVENTION

1. Field of the Invention

The present invention relates to a hand tool, and more particularly to a multi-size wrench which is capable of driving different types of fasteners.

2. Description of the Prior Art

With the coming of automation, most of the works or assembling operations can be done automatically by machines. However, there are still some small assembly procedures that need to be done by hand tools, and also because they are easy to use, that's why the hand tools are developed constantly and becoming more and more perfect and practical. Let's take wrench as an example, although the jaw of an adjustable wrench is adjustable to fit different fasteners, the adjustable wrench is not so light and small that a user can carry it conveniently. Hence, a small and light conventional (nonadjustable) wrench is very useful in many circumstances; however, the operating size of such a wrench is fixed and unchangeable. Hence, Taiwan Pt 349458 discloses a hand tool 10, as shown in FIG. 1, which is defined in its work head 11 with a big engaging groove 111 and a small engaging groove 112 which correspond to the nominal fastener sizes in English and Metric units. As shown in FIG. 2, a 10-mm fastener A in Metric units is engaged in the big engaging groove 111, and as shown in FIG. 3, a ⅜-inch fastener B in English units is engaged in the small engaging groove 112, and thus the work head 11 of the hand tool 10 is adapted to fasteners in both metric and English units. However, Metric and English systems are not the only two systems appeared on the market, so the hand tool 10 won't be useful when it comes to the fasteners in other systems.

The present invention has arisen to mitigate and/or obviate the afore-described disadvantages.

SUMMARY OF THE INVENTION

The primary object of the present invention is to provide a multi-size wrench which is applicable to a Metric hexagonal fastener, an English hexagonal fastener and a torx fastener which are correspondingly sized.

To achieve the above object, the multi-size wrench of the present invention comprises at least one head and a handle portion, wherein the head is defined with an engaging hole for engaging with fasteners, the engaging hole has a center, and an inner surface of the engaging hole of the head is formed by six arc-shaped engaging concaves and six arc-shaped connecting convexes which are alternatively connected to each other in such a manner that between each two neighboring engaging concaves is connected a connecting convexes, each of the engaging concaves includes a first engaging end, a second engaging end and a middle engaging point, and each of the connecting convexes also includes a first connecting end, a second connecting end and a middle connecting point, a line connected between the first engaging end and the center is defined as a first connecting line, a second connecting line is connected from the second engaging end to the center, and an angle between the first and second connecting lines is 49-51 degrees, a third connecting line is connected from the first connecting end to the center of the engaging hole, a fourth connecting line is connected from the middle connecting point to the center of the engaging hole, and an angle between the third and fourth connecting lines is 4-6 degrees.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
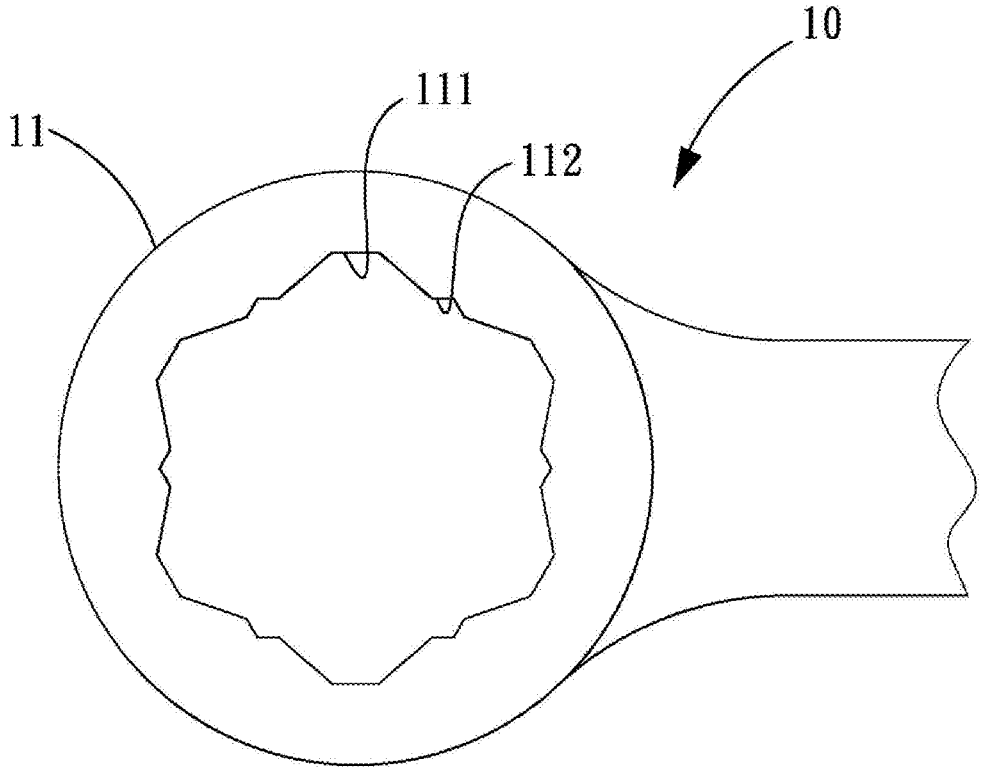
FIG. 1 PRIOR ART
FIG. 1 is a plan view of a conventional wrench both applicable to Metric and English fasteners.
Figure 2:
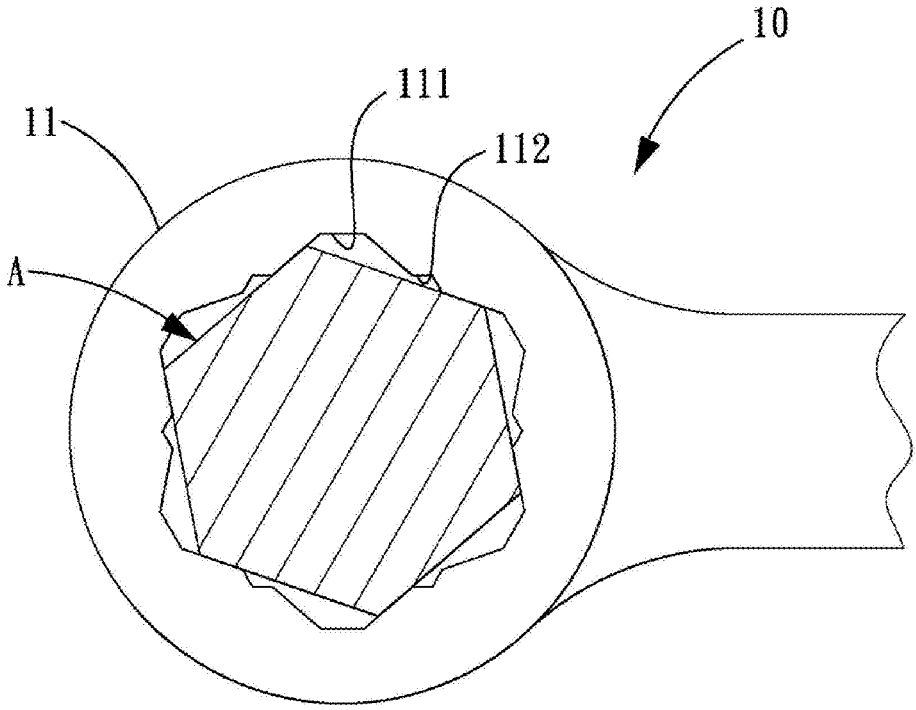
FIG. 2 PRIOR ART
FIG. 2 shows that a Metric fastener is engaged in the wrench of FIG. 1.
Figure 3:
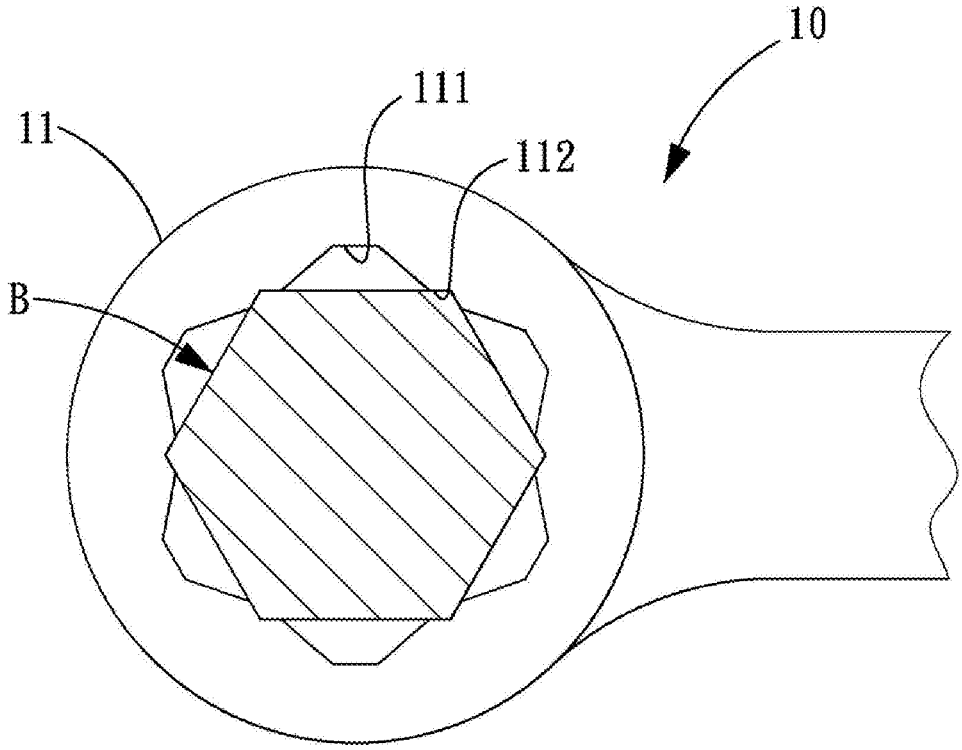
FIG. 3 PRIOR ART
FIG. 3 shows that an English fastener is engaged in the wrench of FIG. 1.
Figure 4:
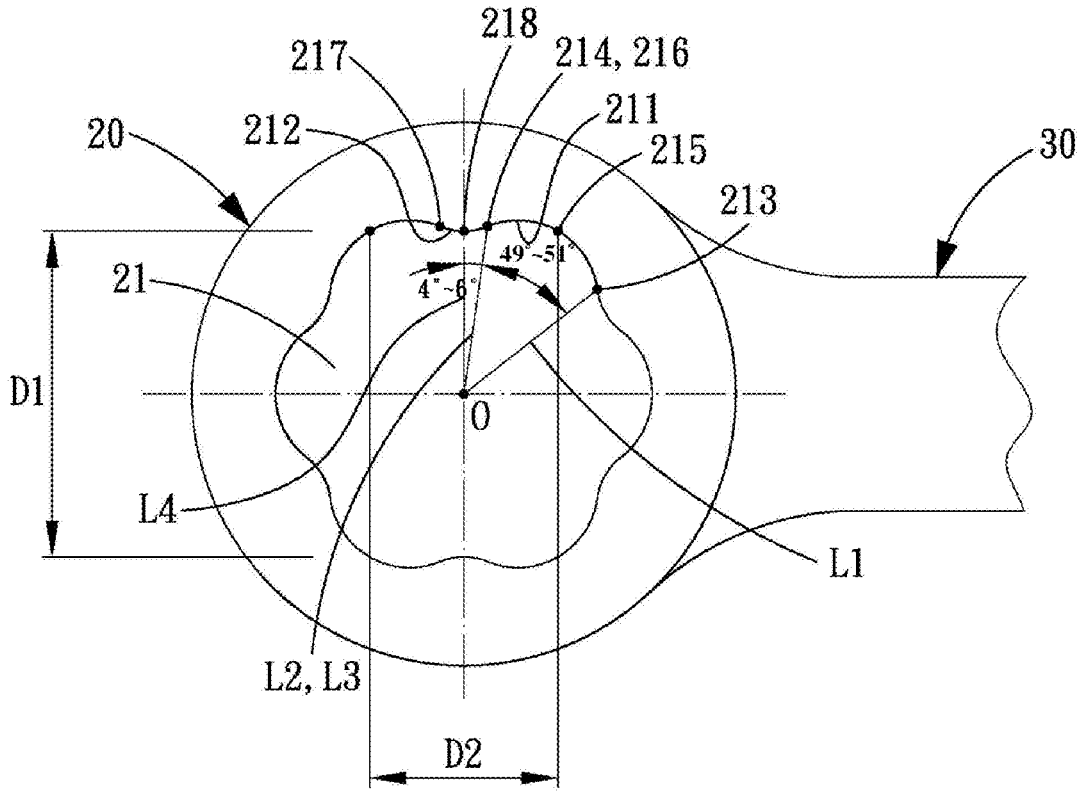
FIG. 4 is an illustrative view of a multi-size wrench in accordance with a first embodiment of the present invention.

Referring to FIG. 4, a multi-size wrench in accordance with the present invention comprises a head 20 connected to a handle portion 30.

The head 20 is defined with an engaging hole 21 for engaging with fasteners. The engaging hole 21 has a center O, and the inner surface of the engaging hole 21 of the head 20 is formed by six arc-shaped engaging concaves 211 and six arc-shaped connecting convexes 212 which are alternatively connected to each other in such a manner that between each two neighboring engaging concaves 211 is connected a connecting convex 212. Each of the engaging concaves 211 includes a first engaging end 213, a second engaging end 214 and a middle engaging point 215, and each of the connecting convexes 212 also includes a first connecting end 216, a second connecting end 217 and a middle connecting point 218. A line connected between the first engaging end 213 and the center O is defined as a first connecting line L1, a second connecting line L2 is connected from the second engaging end 214 to the center O, and an angle between the first and second connecting lines L1, L2 is 49-51 degrees and optimally 50 degrees. A third connecting line L3 is connected from the first connecting end 216 to the center O of the engaging hole 21, a fourth connecting line L4 is connected from the middle connecting point 218 to the center O of the engaging hole 21, and an angle between the third and fourth connecting lines L3, L4 is 4-6 degrees and optimally 5 degrees. A distance between two opposite middle connecting points 218 is D1 which corresponds to a nominal hexagonal fastener size in Metric system, namely the distance across the flats of the hexagonal fastener 40 in Metric system. A distance between two neighboring middle engaging points 215 is D2 which corresponds to the length of the respective flats of the Metric hexagonal fastener 40.

Figure 5:
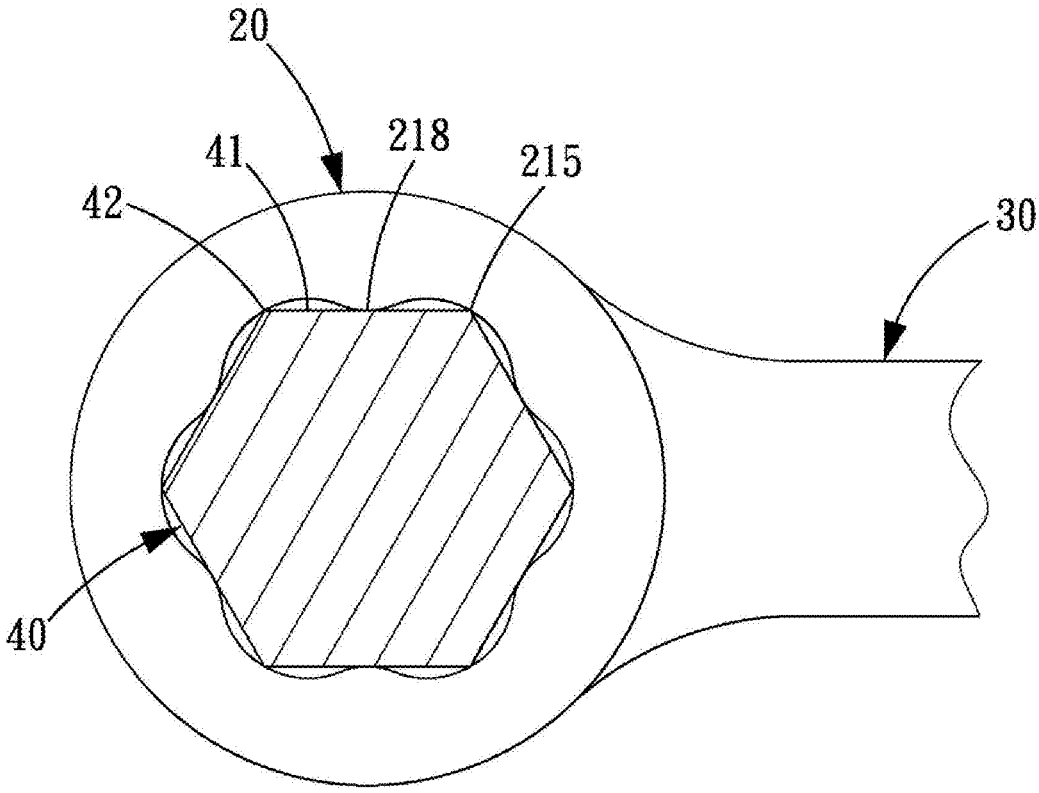
FIG. 5 shows that a Metric hexagonal fastener is engaged in the multi-size wrench in accordance with the first embodiment of the present invention.

The multi-size wrench of the present invention is applicable to three different hexagonal fasteners which are in different measurement systems but similarly and correspondingly sized. For example, a 10-mm hexagonal fastener 40 in Metric system corresponds to a ⅜-inch hexagonal fastener 40' in English system and an E12 torx fastener 40". The distances across the flats of the 10-mm hexagonal fastener 40 in Metric system is 10 mm, of the ⅜-inch hexagonal fastener 40' in English system and of the E12 torx fastener 40" are 10 mm, 9.525 mm and 11.1 mm, respectively. It is apparent that the sizes of the three types of fasteners are close to one another. Hence, when the wrench is engaged with the Metric hexagonal fastener 40 which includes six flats 41 and six angular points 42 between every two neighboring flats 41, as shown in FIG. 5, since the distance D1 between two opposite middle connecting points 218 of the engaging hole 21 of the wrench corresponds to the size of the Metric hexagonal fastener 40, the opposite middle connecting points 218 of the engaging hole 21 of the wrench can press against the corresponding opposite flats 41 of the Metric hexagonal fastener 40. Furthermore, since the distance D2 between two neighboring middle engaging points 215 of the engaging hole 21 of the wrench corresponds to the length of the respective flats of the Metric hexagonal fastener 40, the angular points 42 of the Metric hexagonal fastener 40 can be pressed against the middle engaging points 215 of the engaging hole 21 of the wrench. By such arrangements, the Metric hexagonal fastener 40 is positioned against the multiple points of the arc-shaped engaging concaves 211 and six arc-shaped connecting convexes 212.

Figure 6:
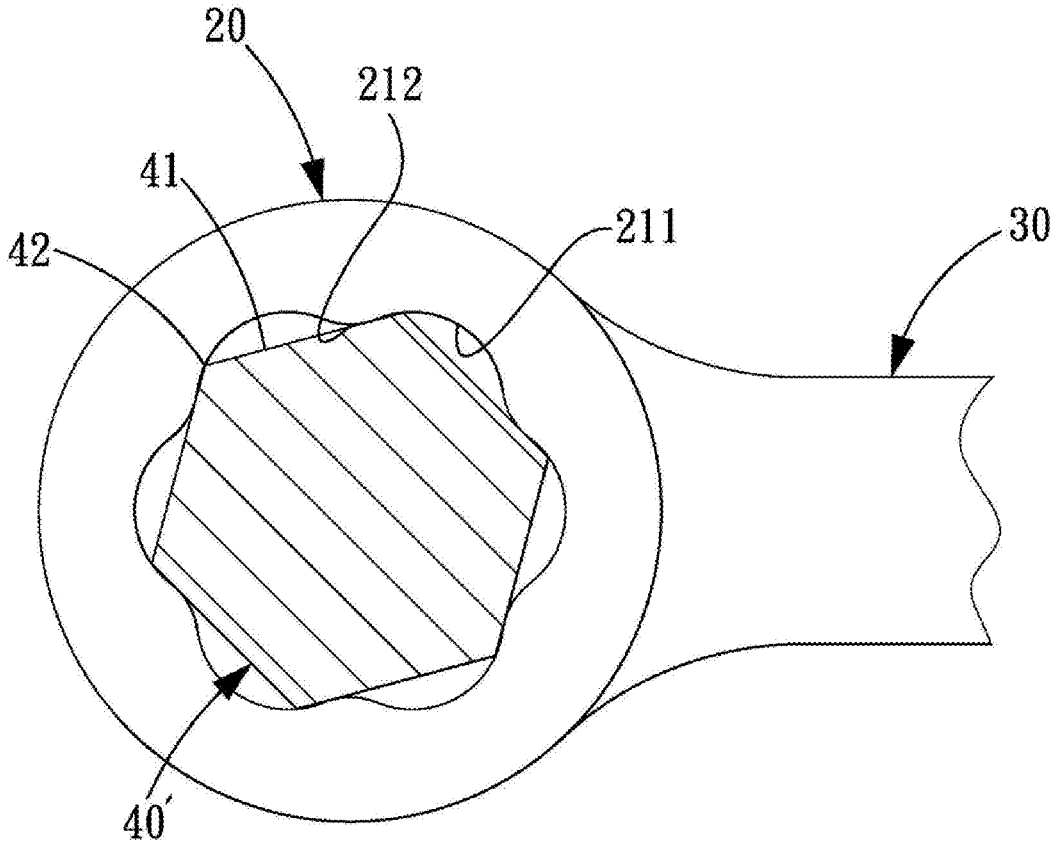
FIG. 6 shows that an English hexagonal fastener is engaged in the multi-size wrench in accordance with the first embodiment of the present invention.

Referring then to FIG. 6, when the English hexagonal fastener 40' is engaged in the wrench, since the distance across the flats of the English hexagonal fastener 40' is slightly smaller than that of the Metric hexagonal fastener 40, the English hexagonal fastener 40' can be positioned against the arc-shaped engaging concaves 211 and six arc-shaped connecting convexes 212 of the engaging hole 21 by rotating it along the arc-shaped engaging concaves 211 of the engaging hole 21.

Figure 7:
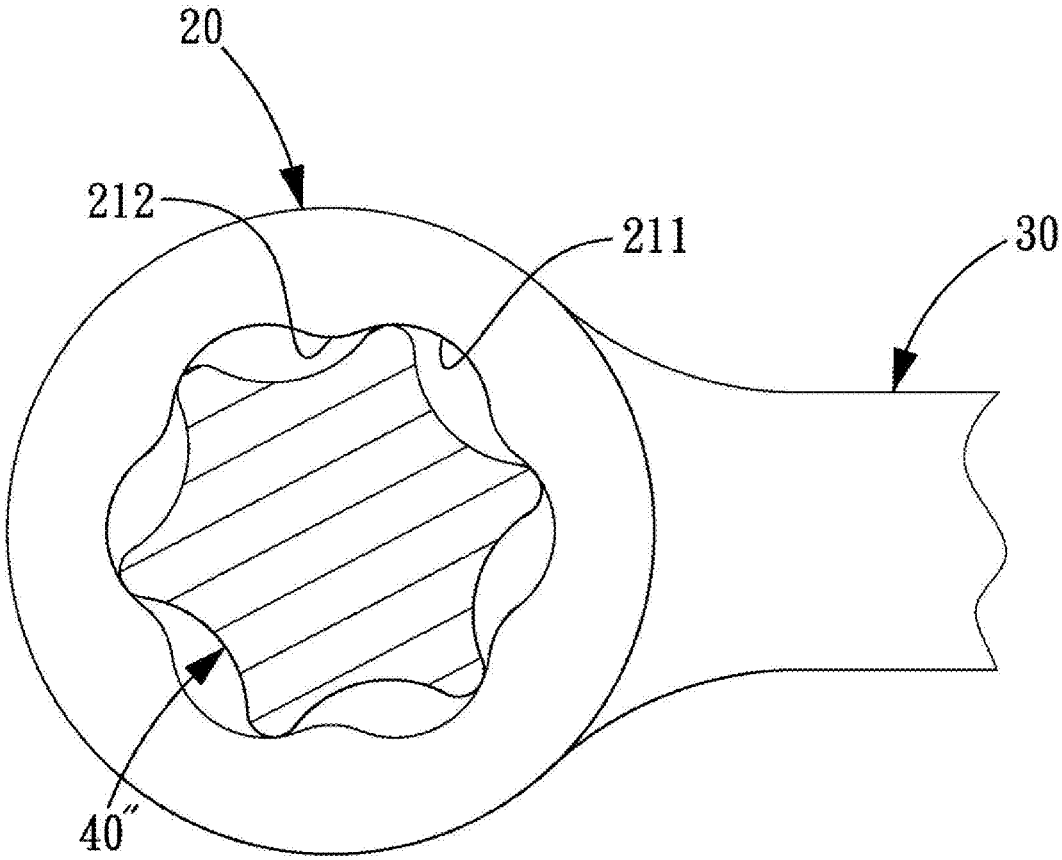
FIG. 7 shows that a torx fastener is engaged in the multi-size wrench in accordance with the first embodiment of the present invention.

Referring then to FIG. 7, the E12 torx fastener 40" can also be positioned against the arc-shaped engaging concaves 211 of the engaging hole 21 when it is engaged in the wrench.

Figure 8:
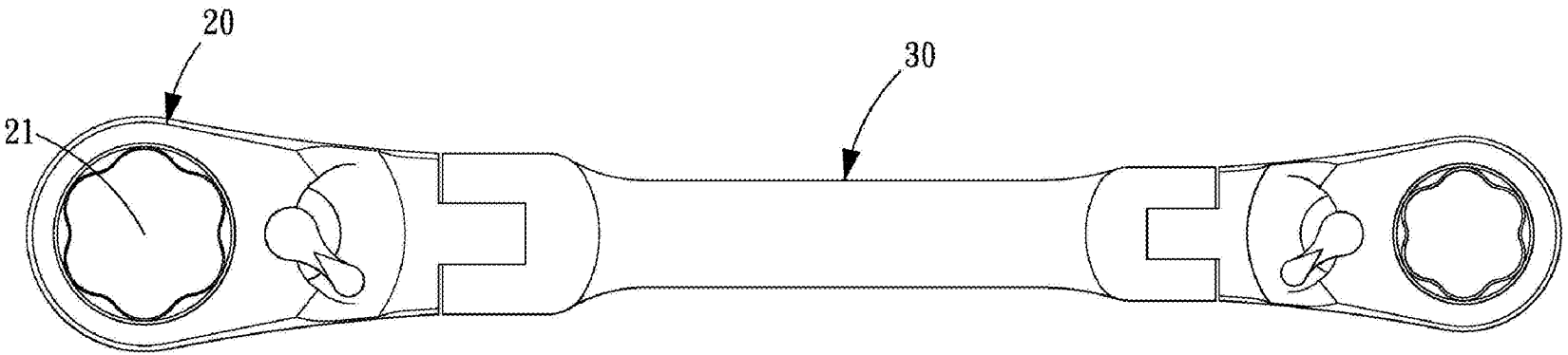
FIG. 8 is an illustrative view of a multi-size wrench in accordance with a second embodiment of the present invention.

The engaging hole 21 of the present invention is not only suitable for use in the conventional wrench but also is applicable to double-head wrench, as shown in FIG. 8, wherein the wrench is provided at both ends thereof with two heads 20 in each of which is defined an engaging hole 21, and the two engaging holes 21 have different size. Hence, when an engaging hole 21 is applicable to three types of fasteners, the double-head wrench would be adapted to six types of fasteners.

Figure 9:
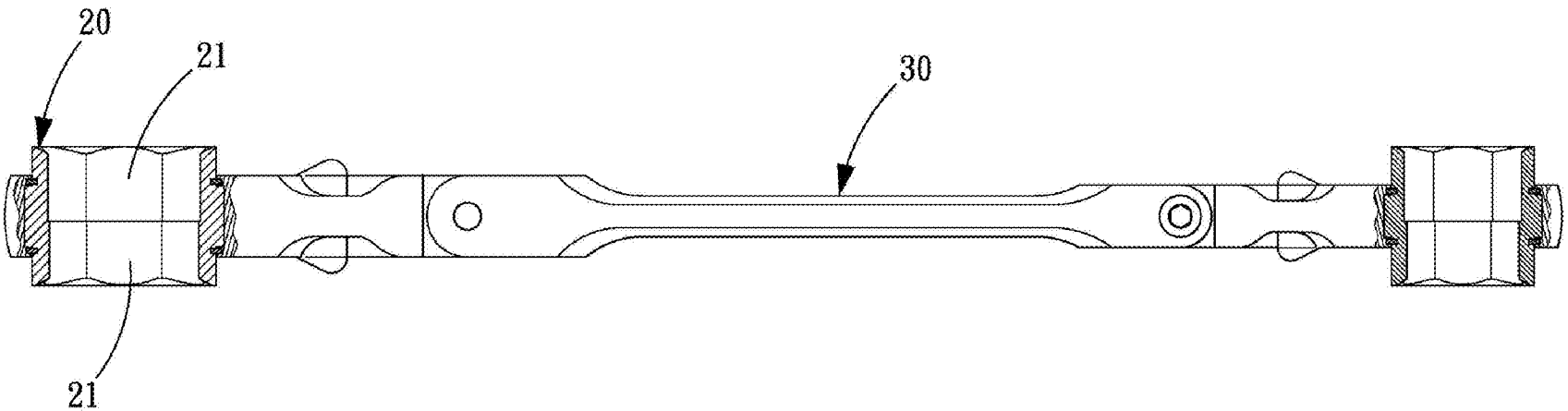
FIG. 9 is an illustrative view of a multi-size wrench in accordance with a third embodiment of the present invention.

Moreover, FIG. 9 shows a double-layer and double-head wrench, wherein each of the heads 20 at each end of the wrench is provided with an upper-layer hole and a lower-layer hole which have different sizes, so that the wrench has four different sized engaging holes 21, and each engaging hole 21 is applicable to three types of fasteners. Therefore, the double-layer and double-head wrench would be adapted to 12 types of fasteners. In addition, since the engaging holes 21 are defined in the heads 20 which are connected to a handle portion 30, with the variation of the engaging holes 21 of the heads 20, a single wrench can be used to drive different types of fasteners without having to produce a different wrench for each sized engaging hole 21, so that the present invention is not only improved in applicability but also reduced in cost.

While we have shown and described various embodiments in accordance with the present invention, it is clear to those skilled in the art that further embodiments may be made without departing from the scope of the present invention.

What is claimed is:

1. In a multi-size wrench comprising at least one head with an engaging hole for engaging with fasteners and a handle portion, an inner surface of the engaging hole of the head being formed by six arc-shaped engaging concaves and six arc-shaped connecting convexes which are alternatively connected to each other in such a manner that between each two neighboring engaging concaves is connected a connecting convexes such that the engaging hole of the wrench is applicable to both a Metric hexagonal fastener and a correspondingly sized English hexagonal fastener, the improvement comprising:

each of the engaging concaves includes a first engaging end, a second engaging end and a middle engaging point, and each of the connecting convexes also includes a first connecting end, a second connecting end and a middle connecting point, an angle between the first and second engaging ends of the engaging concaves with respect to a center of the engaging hole is 49~51 degrees, an angle between the first connecting end and the middle connecting point of the engaging convexes with respect to the center of the engaging hole is 4~6 degrees, so that the engaging hole of the wrench is also applicable to a correspondingly sized torx fastener.

2. The multi-size wrench as claimed in claim 1, wherein the angle between the first and second engaging ends of the engaging concaves with respect to the center of the engaging hole is 50 degrees.

3. The multi-size wrench as claimed in claim 1, wherein the angle between the first connecting end and the middle connecting point of the engaging convexes with respect to the center of the engaging hole is 5 degrees.

4. The multi-size wrench as claimed in claim 1, wherein a distance between two opposite middle connecting points corresponds to a distance across flats of the Metric hexagonal fastener, and a distance between two neighboring middle engaging points corresponds to a length of each of the flats of the Metric hexagonal fastener.

5. The multi-size wrench as claimed in claim 1, wherein the wrench is provided at both ends thereof with two heads in each of which is defined an engaging hole.

6. The multi-size wrench as claimed in claim 1, wherein the wrench is provided at both ends thereof with two heads each of which is provided with an upper-layer hole and a lower-layer hole which have different sizes.

* * * * *